US006465939B1

(12) United States Patent
Ward et al.

(10) Patent No.: US 6,465,939 B1
(45) Date of Patent: Oct. 15, 2002

(54) ROBUST LAMP FILAMENT

(75) Inventors: Patrick C. Ward, West Hartford, CT (US); Robert E. Cassidy, Lebanon, NH (US)

(73) Assignee: LCD Lighting, Inc., Orange, CT (US)

( * ) Notice: Subject to any disclaimer, the term of this patent is extended or adjusted under 35 U.S.C. 154(b) by 0 days.

(21) Appl. No.: 09/453,731

(22) Filed: Dec. 2, 1999

(51) Int. Cl.[7] ..... H01J 1/88; H01J 19/42

(52) U.S. Cl. ..... 313/271; 313/269; 313/493; 313/491; 313/346 R

(58) Field of Search ..... 313/271, 269, 313/493, 491, 346 R

(56) References Cited

U.S. PATENT DOCUMENTS 2,218,345 A * 10/1940 Spaeth ..... 313/578
2,359,302 A * 10/1944 Curtis ..... 445/32
3,283,197 A * 11/1966 Elliott ..... 313/266
3,725,720 A * 4/1973 Petro et al. ..... 313/344
4,506,187 A * 3/1985 Hofmann et al. ..... 313/341
5,971,567 A * 10/1999 Van Duijneveldt ..... 362/296

* cited by examiner

*Primary Examiner*—Michael H. Day
*Assistant Examiner*—Glenn D. Zimmerman
(74) *Attorney, Agent, or Firm*—Fattibene & Fattibene; Paul A. Fattibene; Arthur T. Fattibene

(57) ABSTRACT

A robust coiled filament electrode for a fluorescent lamp used in high vibration environments. A cylindrical mandrel is placed within coils in each end of a coiled filament electrode. The mandrel and the coiled filament electrode are held by a mounting post. The mounting post is bent over and crimped, holding the mandrel and coiled filament electrode. The mandrel extends inward between the two mounting posts, providing support for the coiled filament electrodes. The coiled filament electrode may be made by method or process of chemically dissolving selected portions of a mandrel. Lamp life is extended, as well as the variance between lamp life is substantially reduced. The present invention is particularly applicable to applications in avionics.

2 Claims, 3 Drawing Sheets

ROBUST LAMP FILAMENT

FIELD OF THE INVENTION

This inventions relates generally to fluorescent lamp electrodes, and more particularly to a coiled filament electrode for use in high vibration environments.

BACKGROUND OF THE INVENTION

Fluorescent tube lamps are used in many applications due to their desirable characteristics. A fluorescent lamp generally comprises a tube having a filament electrode at either end with the interior of the tube coated with a fluorescent material. The filament electrode usually comprises a coil of relatively thin wire. The coil is attached to a lead-in wire to which electrical contact is made with the filament electrode. The filament electrode being made of a coil or relatively thin wire is relatively delicate. The use of multiple coils additionally makes the filament electrode relatively delicate and often difficult to attach to a support or lead-in wire. The use of additional supports may add weight to the filament electrode which is disadvantageous, especially in high vibration environments. Accordingly, in high vibration environments, such as applications in avionics, premature lamp failure often results due to breakage of the filament electrode where it is attached to a mount or support. Additionally, it has been determined that there is a large variation in lamp life in a high vibration environment. Some lamps may fail relatively quickly, while other lamps have a much longer life. Therefore, it is often very difficult to predict lamp life. This results in unpredictable failures, or additional cost to provide more frequent maintenance replacements to avoid an unexpected failure. This is particularly disadvantageous in applications where a lamp failure may be critical, such as in avionics.

Additionally, filaments are often made of tungsten which is a refractory metal and in standard practice, is never melted but rather is made into wire by a combination of staging and drawing. As a result, tungsten is a metal with a pronounced grainy structure and gives tungsten a characteristic brittleness or tendency for small micro-cracks to propagate along the grain boundaries if subject to stress may be caused by vibration. Typically, multi-coiled tungsten filaments must be secured to lead-in connectors by either clamping or welding. If clamped, the tungsten filament must be clamped with sufficient force to provide good electrical contact and ensure that the filament does not come loose. However, the clamping must not be excessive so as to severely damage the crystal structure by inducing severe grain boundary cracks. In standard usage the clamping need be only minimally sufficient to survive stresses induced by shipping. Once installed in a low vibration environment, such as a home or office, it can be expected to perform well. Therefore, clamping variations in a low vibration environment is seldom critical. However, when subjected to severe vibration and shock, such as in avionics, the clamping becomes critical. A slightly under clamped filament can easily become loose under vibration, while an over clamped filament can induce micro cracks in the grain which will propagate along the grain boundaries resulting in a break at the filament—clamp juncture. There is currently no nondestructive test that can determine if the clamping is adequate.

Therefore, there is a need to improve the vibration resistance or robustness of filament electrodes used in fluorescent lamps. There is also a need to improve the consistency of lamp life so that any lamp failure can be readily predicted, providing for improved and more reliable maintenance schedules.

SUMMARY OF THE INVENTION

The present invention is directed to a robust fluorescent lamp filament electrode suitable for high vibration environments. In a coiled filament attached to mounting posts, a mandrel is placed within each end of the coiled filament where it attaches to the mounting post. A portion of the mounting post is bent and crimped over each end of the coiled filament with the mandrel placed therein. A portion of the mandrel extends inward towards the portion of the coiled filament between the two mounting posts. Vibrations in the coiled filament between the two mounting posts are effectively dampened, reducing metal fatigue where the coiled filament is attached to the mounting posts. Additionally, the mandrel helps to secure the coiled filament in the mounting posts. The mandrels may be formed in the coiled filament by winding a tungsten wire around a molybdenum mandrel which is chemically dissolved except for end leg sections which are clamped.

Accordingly, it is an object of the present invention to improve the life of a fluorescent lamp having a coiled filament electrode.

It is another object of the present invention to improve consistency of the life of the lamp.

It is an advantage of the present invention that it is relatively easily manufactured.

It is a further advantage of the present invention that existing coiled filament electrodes can be used.

It is a feature of the present invention that a mandrel is placed or allowed to remain within each end of the coiled filament electrode where the electrode is attached to a mounting post.

These and other objects, advantages, and features will become readily apparent in view of the following more detailed description.

DETAILED DESCRIPTION OF THE PREFERRED EMBODIMENTS

Figure 1:
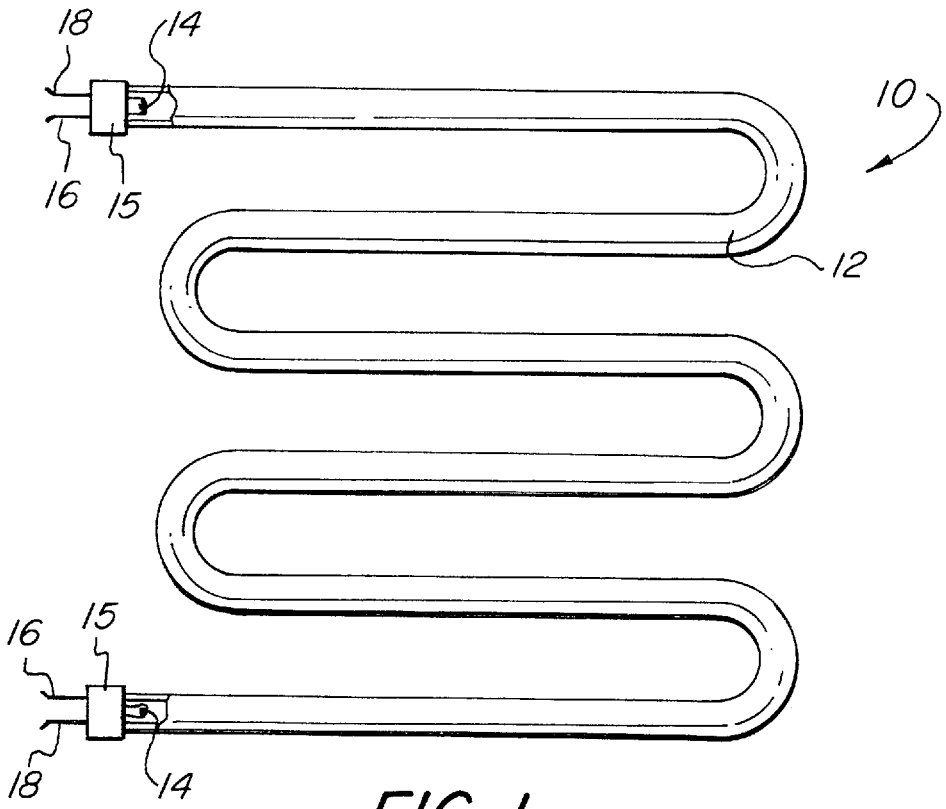
FIG. 1 is an elevational view of a serpentine fluorescent lamp.

FIG. 1 is an elevational view of a fluorescent serpentine tubular lamp 10. The fluorescent lamp 10 comprises glass tubing 12 having coiled filament electrodes 14 placed in either end. Generally, a gas is placed within the tubing 12 and a phosphorescent coating is placed on the inside surface of the tubing 12. Each coiled filament electrode 14 is held by a pin base or cap 15. A first lead or contact pin 16 is coupled to one end of the coiled filament electrode and a second lead or contact pin 18 is coupled to another end of the coiled filament electrode 14. Accordingly, contact pin 18 may be coupled to an electric potential with contact pin 16 grounded or at a lower electric potential to induce current in the coiled filament electrodes 14, thereby causing the fluorescent lamp to radiate electromagnetic radiation. The fluorescent serpentine lamp 10 is often used in applications for backlighting a display. Generally, the display may be a liquid crystal display or LCD. Such displays are widely used in avionics, and other high vibration environments.

Figure 2:
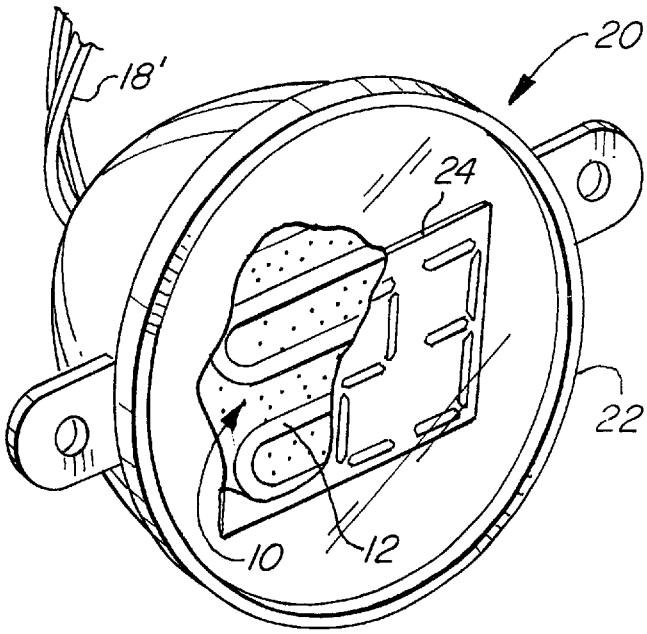
FIG. 2 is a perspective view, in partial section, illustrating an application of the present invention.

FIG. 2 is a perspective view of an instrument illustrating an application of the present invention. An instrument 20 has a housing 22. Contained within the housing 22 is tubing 12 of the fluorescent serpentine lamp, illustrated in FIG. 1. Leads 18' connect the fluorescent lamp 10 to any conventional power source. In front of the fluorescent serpentine lamp 10 is a display 24, which may be a liquid crystal display. The liquid crystal display 24 may have indicia 26, for example numbers. However, it should be appreciated that any display may be utilized.

Figure 3A:
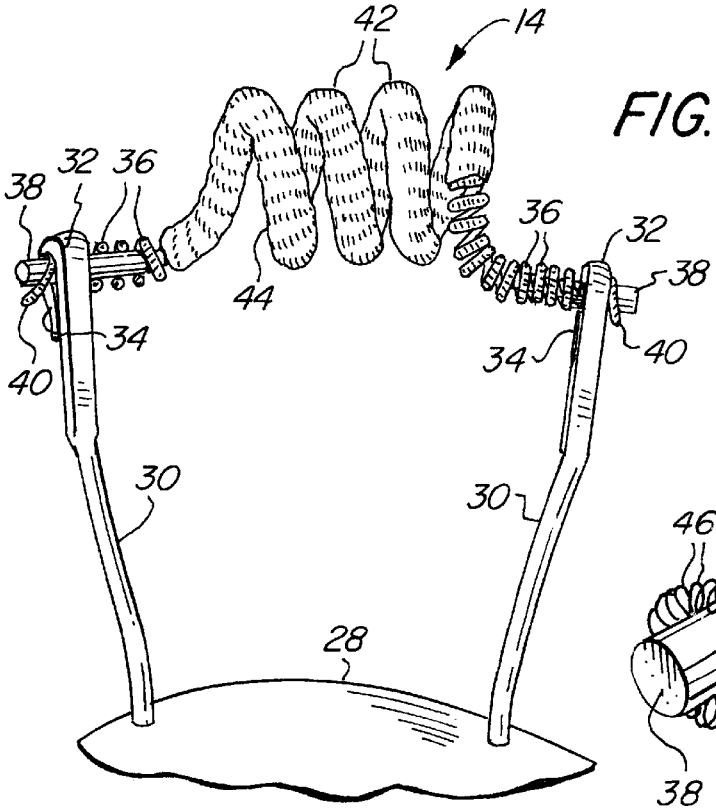
FIG. 3A is a perspective view of a coiled filament electrode having a partial section at one end of the coiled filament electrode.
Figure 3C:
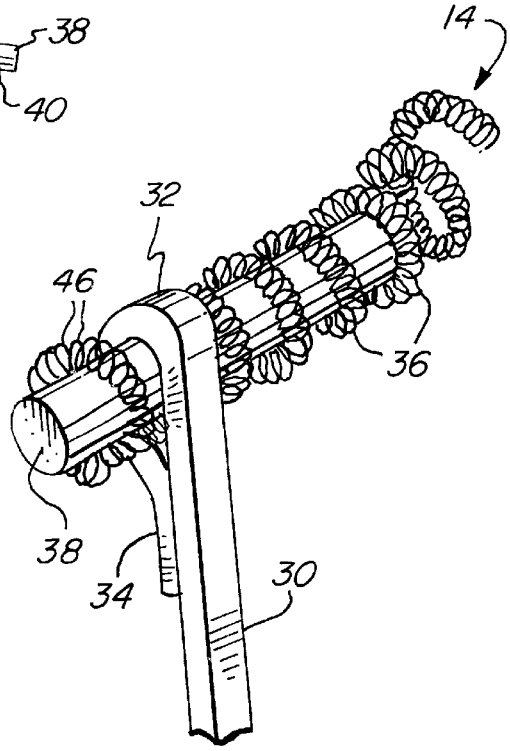
FIG. 3C is a partial perspective view of a portion of the present invention.
Figure 3B:
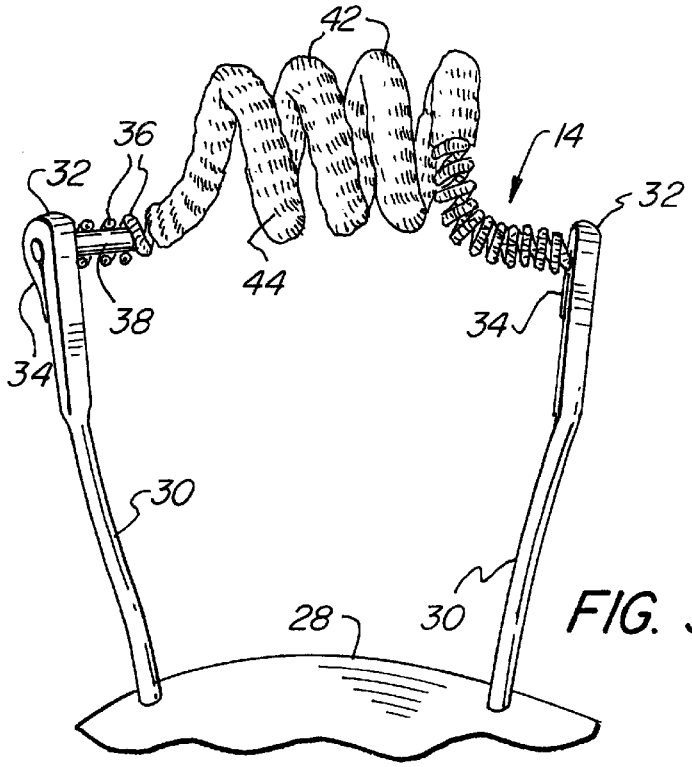
FIG. 3B is a perspective view of a coiled filament electrode with a partial section and trimmed ends.

FIGS. 3A–C are perspective views more clearly illustrating the improved coil filament electrode of the present invention. An insulator or exhaust tube 28 formed within the cap or pin base 15, illustrated in FIG. 1, holds therein two lead-in wires or mounting posts 30. Each of the mounting posts 30 have a bend or a loop 32 therein with a crimped distal end 34. The coiled filament electrode 14 may be of the triple coil type having a plurality of coils within coils. A coiled wire forms second coils 36 around a mandrel 38. The second coils 36 extend around the mandrel 38 and through the bend 32 forming a tail 40. The second coils 36 are formed into a third coils 42. The third coils 42 may have a coating 44 thereon. Coating 44 may be any well known coating used with fluorescent lamp electrodes. The second coils 36 adjacent the left mounting post 30 have been partially sectioned to better illustrate the mandrel 38. The cylindrical mandrel 38 is securely held within the bend or loop 32 of the mounting post 30. The mandrel 38 improves the attachment of the coiled filament electrode 14 to the mounting post 30. The loop 32 and the distal end 34 are crimped or squeezed so as to retain the coiled filament electrode 14 and the mandrel 38 within the end of mounting post 30. The mandrel 38 may initially extend beyond the mounting post 30, away from the coiled filament electrode 14, with the other end of the mandrel 38 extending inward towards the coiled filament electrode 14 and third coils 42. The mandrel 38 need only extend inward for a length equal to several of the second coils 36 and near the transition to the larger third coils 42. FIG. 3B illustrates the coiled filament electrode 14 having the ends of the mandrel 38 and the tails 40, illustrated in FIG. 3A, removed or cut. While the removal or cutting of the ends of the mandrel 38 and tails 40 extending on the outside of the mounting post 30 is illustrated in FIG. 3B, their removal is not required in practicing the present invention.

FIG. 3C is a perspective view more clearly illustrating one mounting post 30 and the attachment of the coiled filament electrode 14 having a mandrel 38 therein. The coiled filament electrode 14 is a triple coil filament having a first coil 46 of wire which is formed into second coils 36 around a cylindrical mandrel 38. The second coils 36 are again coiled forming third coils 42, as illustrated in FIGS. 3A and 3B. Accordingly, a triple coil filament electrode is obtained.

Figure 4:
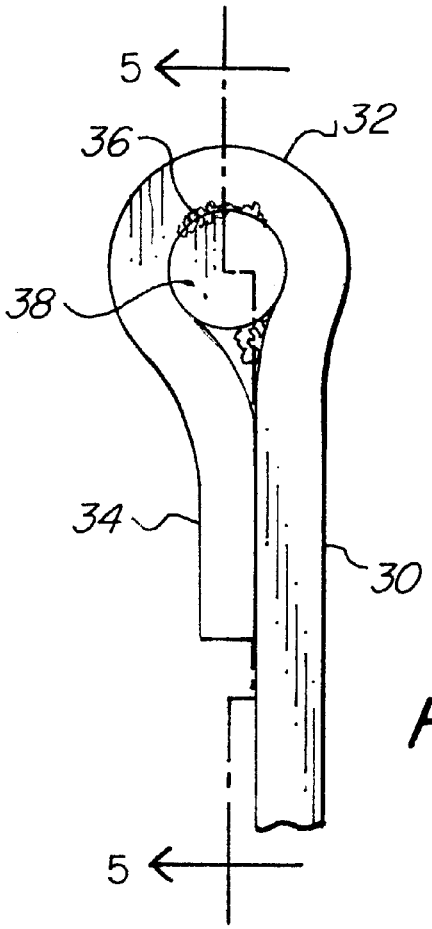
FIG. 4 is a side elevational view of a portion of a mounting post.

FIG. 4 is an end view illustrating the attachment of a coiled filament electrode to the mounting post. The mounting post 30, having a bend or loop 32 encircles the mandrel 38. Second coils 36 of the coiled filament electrode are coiled around the mandrel 38 and extend into the loop 32 formed by the mounting post 30. The distal end 34 of the mounting post 30 is crimped or squeezed around the mandrel 38 and second coils 36 of the coiled filament electrode. This provides a friction or press fit, securely holding the mandrel 38 and second coils 36 of the coiled filament electrode.

Figure 5:
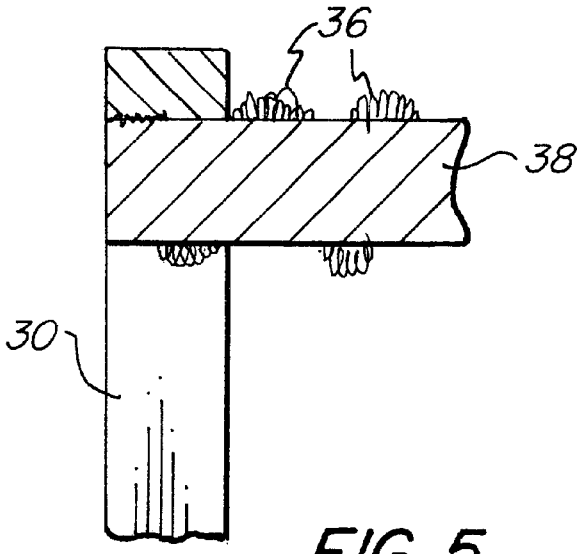
FIG. 5 is a cross section taken along line 5—5 in FIG. 4.

FIG. 5 is a cross section taken along line 5-5 in FIG. 4. FIG. 5 more clearly illustrates the structure of the present invention and the support the mandrel 38 provides for the second coils 36 of the coiled filament electrode. The use of the mandrel 38 greatly aids in the securing of the relatively thin coiled filament electrode to the mounting post 30.

The present invention can be made by the following method. In a coil winding operation a tungsten wire is wound around a mandrel. The mandrel may be made of a refractory metal, such as molybdenum or moly. After repeated coilings, the mandrels are chemically dissolved resulting in the finished filament which typically consists of a central barrel region and leg sections which are to be clamped. Prior to the dissolving operation, the leg sections are protected from the dissolving chemical by applying a protective coating. Therefore, the heavy molybdenum mandrels are retained in the leg sections providing an exceptionally strong and solid structure that can be securely clamped without danger of cracking.

The use of a mandrel in providing support for the coiled filament electrode greatly improves the reliability of fluorescent lamps used in high vibration environments. Additionally, the present invention substantially reduces the lamp failure variance. The electrode structure of the present invention greatly improves resistance to vibration and is particularly applicable to applications in avionics. In testing, the present invention resulted in much longer lamp life in a high vibration environment than prior filament electrodes not utilizing the structure of the present invention. Additionally, lamp life variance was substantially reduced, making for an improved lamp with a more predictable life. No detrimental electrical or performance effects were found for the filament structure of the present invention. However, a slight increase in filament resistance may be noticed.

Accordingly, the present invention greatly improves lamp life in high vibration environments. This is especially important in many critical applications such as for use in avionics. Additionally, while the present invention has been illustrated with respect to a triple coiled type filament electrode, the present invention may be applied equally well to any coiled filament electrode. Therefore, although the preferred embodiment has been illustrated and described, it will be obvious to those skilled in the art that various modifications may be made without departing from the spirit and scope of this invention.

What is claimed is:

1. A fluorescent lamp used in back lighting a liquid crystal display in a high vibration environment comprising:

a serpentine tube having two open ends and a phosphorescent coating;

a cap placed on each of the two open ends;

a mounting post placed within each said cap;

a triple coiled filament electrode having two coiled ends; and a uniform diameter cylindrical mandrel placed in each of the two coiled ends a length extending an axial distance of at least two coils, one of said mounting posts crimped over each of the two coiled ends and said uniform diameter cylindrical mandrels, whereby the fluorescent lamp is more robust in the high vibration environment.

2. A fluorescent lamp used in back lighting a liquid crystal display in a high vibration avionics environment comprising:

a tube having two open ends and a phosphorescent coating;

a cap placed on each of the two open ends;

a mounting post placed within each said cap;

a coiled filament electrode having two coiled ends;

a coating placed on said coiled filament electrode; and a uniform diameter cylindrical mandrel placed in each of the two coiled ends a length extending an axial distance of at least two coils, one of said mounting posts crimped over each of the two coiled ends and said uniform diameter cylindrical mandrels, whereby the fluorescent lamp is more robust and less prone to failure in the high vibration avionics environment.

* * * * *